United States Patent [19]

Autry

[11] Patent Number: 4,534,121

[45] Date of Patent: Aug. 13, 1985

[54] INSOLE WITH CONCENTRIC CIRCULAR HEEL STRUCTURE

[75] Inventor: James C. Autry, Dallas, Tex.

[73] Assignee: Autry Industries, Inc., Dallas, Tex.

[21] Appl. No.: 570,967

[22] Filed: Jan. 16, 1984

[51] Int. Cl.[3] ..... A43B 21/26

[52] U.S. Cl. ..... 36/35 R; 36/43

[58] Field of Search ..... 36/43, 44, 35 R, 35 A, 36/35 B, 28

[56] References Cited

U.S. PATENT DOCUMENTS

| | | | |
|---|---|---|---|
| 901,236 | 10/1908 | Gordon | 36/44 X |
| 2,146,888 | 2/1939 | Fisch | 36/44 X |
| 3,154,867 | 11/1964 | Strope | 36/35 R |
| 4,075,772 | 2/1978 | Sicurella | 36/43 |

FOREIGN PATENT DOCUMENTS

| | | | |
|---|---|---|---|
| 1511344 | 12/1967 | France | 36/43 |

*Primary Examiner*—Werner H. Schroeder

*Attorney, Agent, or Firm*—Jerry W. Mills; Gregory M. Howison

[57] ABSTRACT

A shoe insole includes a heel portion (12), a mid portion (14) and a toe portion (16). On the under surface of the shoe insole, a cylindrical disc (18) is formed in the center of the heel portion (12). Annular rings (20) and (22) are also formed in the heel portion (12) and concentrically disposed about the cylindrical disc (18). A plurality of arcuate ridges (24) are disposed on the mid portion (14) and constituting arcs of concentric circles radiating outward from said cylindrical disc (18). The cylindrical disc (18), the annular ridges (20) and (22) and the arcuate ridges (24) have essentially the same height and are formed of a highly resilient material such as polyurethane.

3 Claims, 4 Drawing Figures

INSOLE WITH CONCENTRIC CIRCULAR HEEL STRUCTURE

TECHNICAL FIELD OF THE INVENTION

The present invention pertains in general to insoles for insertion into a shoe, and more particularly, to the structure of the heel therefor.

BACKGROUND OF THE INVENTION

Insoles are primarily designed to be inserted into the shoe for the purpose of providing support for various surfaces of the foot. In addition to support, they also function to cushion the foot within the shoe during normal walking, running and/or standing. The cushioning effect is a function of both the design of the insole and the material with which the insole is fabricated. For example, present insoles utilize polyethylene to provide a certain degree of resiliency for the insole. However, the resilient effect provided by these insoles is minimal since this material has less than approximately 10 percent resiliency. This results in a relatively hard insole disposed adjacent the sole of the foot and the heel therefor.

Since a large portion of the weight of an individual is supported on the heel with the toes primarily providing balance, it is important that an insole provide increased cushioning to the heel. When the weight is shifted from one foot to another when walking or running, it is necessary to absorb any shocks that are present when the heel strikes the ground. The heel itself provides a certain degree of hydraulic cushioning internal thereto to reduce the shock. However, there exists a need for additional shock absorption that can be provided by an insole. This shock absorption is not provided by present insoles in that the structure thereof and the material that they are fabricated from does not provide the requisite amount of shock absorption for the heel or foot.

SUMMARY OF THE INVENTION

The present invention disclosed and claimed herein comprises an insole for insertion into a shoe to provide cushioning for the foot. The insole includes a layer of cushioning material fabricated from a resilient material and having one surface thereof for being disposed adjacent the sole of the foot and generally having a profile around the perimeter thereof similar to that of the foot. The cushioning layer has a heel portion for disposal adjacent the heel of the foot, a mid portion for disposal adjacent the arch of the foot and a toe portion for disposal adjacent the toes of the foot. Cushioning ridges are formed on the surface of the cushioning layer opposite the foot supporting surface. The ridges are primarily located on the heel and mid portions of the cushioning layer. Of these ridges, the ridges disposed on the heel portion are arranged in concentric circles emanating from a radial center in the middle of the heel portion. The ridges on the mid portion form an arc of concentric circles having the radial center in the middle of the heel portion.

In another embodiment of the present invention, a cylindrical shaped disc is formed at the radial center of the ridges on the heel portion and having the height from the surface of the cushioning layer equal to that of the ridges such that the cylindrical disc provides maximum cushioning at the rotating center of the heel of the foot. The cushioning layer with the ridges and the cylindrical disc formed therein are formed of a resilient material and the space between adjacent sides of ridges and the cylindrical disc is sufficiently wide enough to prevent contact when the cushioning layer is under compression.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
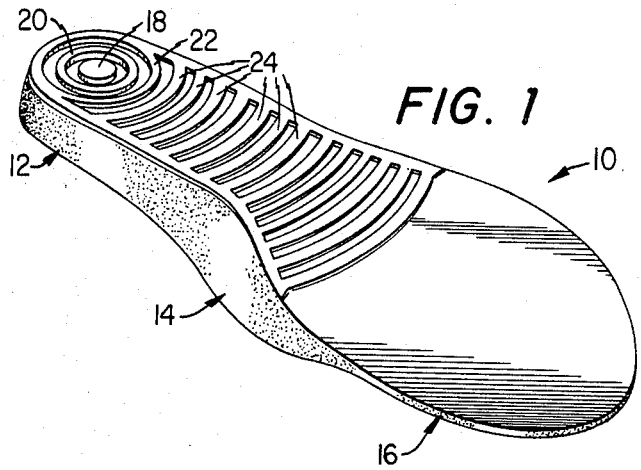
FIG. 1 illustrates a perspective view of an insole in accordance with the present invention with the underside facing upwards.
Figure 2:
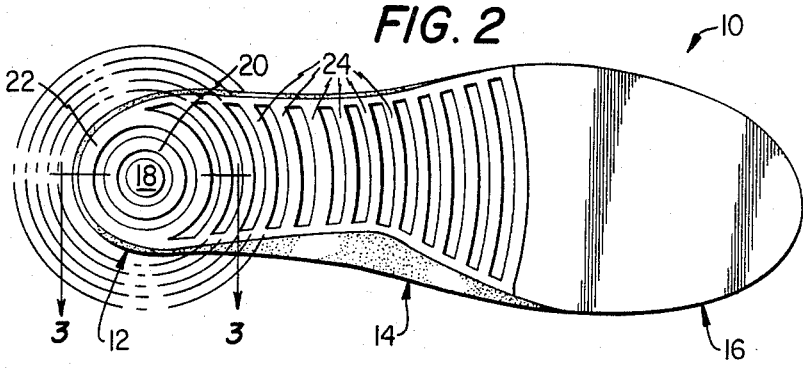
FIG. 2 illustrates a bottom plan view of the insole in accordance with the present invention.

Referring now to FIGS. 1 and 2, there are illustrated a perspective view of an insole with the under surface facing upward and a plan view of the under surface. The insole 10 is functional to insert into a shoe to provide cushioning therefor. Although not shown, the upper surface of the insole 10 is conformed to the contour of the sole of the foot in order to better disperse forces thereabout.

The insole 10 is divided into a heel portion 12, a mid portion 14 and a toe portion 16. The heel portion 12 and the mid portion 14 have a plurality of ridges formed integral therewith. The ridges are formed from concentric circles, as best illustrated in FIG. 2, emanating from a radial center on the heel portion 12. At the radial center of the concentric circles in the middle of the heel portion 12, there is disposed a raised disc 18 having a cylindrical shape. Disposed radially outward from the disc 18 is a first annular ridge 20. A second annular ridge 22 is disposed concentrically about both the disc 18 and the annular ridge 20 with the radial centers of the disc 18, the annular ridges 20 and 22 located in the middle of the heel and being common to each other. The second annular ridge 22 forms the rearmost periphery of the heel portion 12. In this manner, the disc 18, the annular ridge 20 and the annular ridge 22 form the bottom surface of the heel portion 12.

A plurality of arcuate ridges 24 are disposed on the surface of the mid portion 14 extending from the second annular ridge 22 toward the toe portion 16. Each of the ridges 24 comprises the arc of a circle having the radial center at the center of the disc 18 on the heel portion 12. As the ridges 24 progress outward from the heel toward the toe portion 16, the length of the arc in degrees decreases as the radius increases.

The disc 18, the annular ridges 20 and 22 and the arcuate ridges 24 are dimensioned such that a space is formed therebetween. The ridges and the insole 10 are integrally molded of a highly resilient material. In the preferred embodiment, polyurethane is utilized which provides a resiliency of approximately 98%. Materials of this type include foamed Poly Vinyl Chloride (PVC). Some of these PVC materials utilize resin modifiers.

One such material is manufactured under the trade name "Elvaloy" by Dupont.

Figure 3:
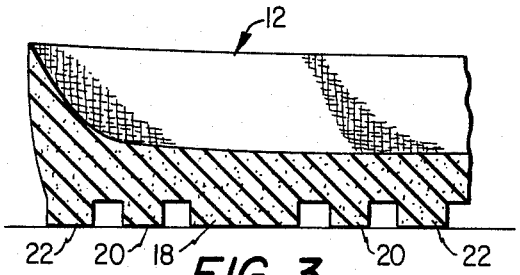
FIG. 3 illustrates a cross-sectional view taken along lines 3—3 of FIG. 2 of the heel showing a detail of the concentric rings.
Figure 4:
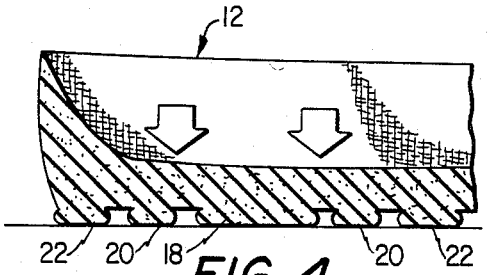
FIG. 4 illustrates the view of FIG. 3 with compressive forces applied to the upper surface of the heel portion of the insole.

Referring now to FIGS. 3 and 4, there are illustrated cross-sectional views of the heel portion 12 taken along lines 3—3 of FIG. 2 with FIG. 3 illustrating a static condition and FIG. 4 illustrating a dynamic condition with weight applied to the upper surface of the heel portion 12. The disc 18 is centered beneath the heel portion and, consequently, absorbs a large portion of the weight from the heel of the foot. This weight causes the disc 18 to compress and expand laterally into the space between the disc 18 and the annular ridge 20. In addition to lateral expansion of the disc 18, the annular ridges 20 and 22 also expand laterally. It is necessary that the spaces between the ridges on the lower surface of both the sole portion 12 and the mid portion 14 have sufficient width to allow lateral expansion of the boundary ridges. If the sides of adjacent ridges were to touch during lateral expansion thereof, then the ridges would be forced into compression, thereby reducing the cushioning effect. In the preferred embodiment, the width of the space between the disc 18, the annular ridges 20 and 22 and the arcuate ridges 24 is approximately equal to the width of the ridges 20–24 and all of these ridges are of equal width. However, the disc 18 has a diameter that is approximately three to four times the width of the ridges 20–24.

By arranging the ridges 20–24 as concentric circles, hydraulic cushioning forces can be directed along the line of motion of the heel of the foot, that is, outward from the center. Since the heel is ball shaped, it essentially rotates about the center thereof with the toes providing support therefor. Therefore, lateral rotation of the heel or forward and backward rotation of the heel will all be compensated for by the concentric circle structure. For example, if the heel rotates towards the medial side of the foot, compressive forces resulting from compression of the annular rings 20 and 22 would be equal to the compressive forces that the foot would incur during rotation to the lateral side of the foot. In this manner, the compressive forces are equally distributed about the heel of the foot in all directions of rotation for the heel.

In summary, there has been provided a shoe insole that is fabricated from a resilient material such as polyurethane that has a plurality of ridges disposed on the under surface thereof. The ridges are arranged along the circumference of concentric circles having the radial center thereof disposed in the middle of the heel portion of the insole. In this manner, the ridges proximate the heel portion provide shock absorption forces that are dispersed concentrically about the rotation point of the heel.

Although the preferred embodiment has been described in detail, it should be understood that various changes, substitutions and alterations can be made therein within departing from the spirit and scope of the invention as defined by the appended claims.

I claim:

1. An insole for disposal between the sole in a shoe, comprising:

a layer of cushioning material for absorbing the shock between the foot and the shoe and having a first surface for being disposed adjacent the sole of the foot and a second surface opposite said first surface for being disposed adjacent the sole of the shoe and generally having a profile around the perimeter thereof similar to that of the foot, said cushioning layer having a heel portion for disposal adjacent the heel of the foot, a mid portion for disposal adjacent the arch of the foot, and a toe portion for disposal adjacent the toes of the foot;

a cylindrical shaped disc formed on the second surface of said cushioning layer adjacent the center of said heel portion for providing cushioning to the central portion of the heel to the foot;

a plurality of annular ridges formed on said second surface in the heel portion adjacent said cylindrical-shaped disc, the radial centers of said annular ridges coinciding with the center of said heel portion and said cylindrical shaped disc; and a plurality of arcuate ridges formed on said second surface in said mid portion, and arcuate ridges forming a plurality of arcs of concentric circles with the progressing radii centered in the middle of said heel portion;

said cylindrical disc, said annular ridges, and said arcuate ridges having essentially equal heights from the second surface of said cushioning layer and having a space between adjacent sides thereof at least equal to the width thereof such that compression of said ridges and said cylindrical disc does not result in contact between the sides thereof.

2. The insole of claim 1 wherein the material from which said cushioning layer is fabricated is polyurethane.

3. The insole of claim 1 where the resiliency of said cushioning layer is greater than 90%.

* * * * *